US010717081B2

(12) United States Patent
Molho et al.

(10) Patent No.: US 10,717,081 B2
(45) Date of Patent: Jul. 21, 2020

(54) MANIPULATION OF OBJECTS IN MICROFLUIDIC DEVICES USING EXTERNAL ELECTRODES

(71) Applicant: Caliper Life Sciences, Inc., Hopkinton, MA (US)

(72) Inventors: Joshua I. Molho, Oakland, CA (US); Daniel G. Stearns, Los Altos Hills, CA (US); I-Jane Chen, Alameda, CA (US); Danh Tran, Hayward, CA (US); Bradley W. Rice, Danville, CA (US); Tobias Daniel Wheeler, Alameda, CA (US)

(73) Assignee: Caliper Life Sciences, Inc., Hopkinton, MA (US)

( * ) Notice: Subject to any disclaimer, the term of this patent is extended or adjusted under 35 U.S.C. 154(b) by 0 days.

(21) Appl. No.: 14/942,166

(22) Filed: Nov. 16, 2015

(65) Prior Publication Data

US 2016/0067706 A1 Mar. 10, 2016

Related U.S. Application Data

(62) Division of application No. 13/705,670, filed on Dec. 5, 2012, now abandoned.

(51) Int. Cl.

| | |
|---|---|
| ***B01L 3/00*** | (2006.01) |
| ***B03C 5/02*** | (2006.01) |
| ***B03C 5/00*** | (2006.01) |

(52) U.S. Cl.

CPC ..... *B01L 3/50273* (2013.01); *B01L 3/502715* (2013.01); *B01L 3/502792* (2013.01);

(Continued)

(58) Field of Classification Search

CPC ..... B01L 3/5027; B01L 3/50273; B01L 3/502715; B01L 3/502792; B03C 5/005; B03C 5/026

See application file for complete search history.

(56) References Cited

U.S. PATENT DOCUMENTS 6,203,683 B1 3/2001 Austin et al.
7,138,269 B2 * 11/2006 Blankenstein ..... B01D 57/02 422/186

(Continued)

FOREIGN PATENT DOCUMENTS

CN 101218032 A 7/2008
EP 0525209 A1 2/1993

(Continued)

OTHER PUBLICATIONS

International Search Report and Written Opinion issued in related international application No. PCT PCT/US2014030750, dated Sep. 11, 2014.

(Continued)

*Primary Examiner* — Gurpreet Kaur
(74) *Attorney, Agent, or Firm* — Day Pitney LLP

(57) ABSTRACT

The invention provides microfluidic devices, systems, and methods for manipulating an object within a channel of a microfluidic device using an external electrode. The device has a channel disposed within the device, the channel having no included electrodes. The channel has a wall, at least a portion of which is penetrable by an electric field generated external to the device, the wall being penetrable such that the electric field extends through the wall portion and into a region within the channel. The system includes the microfluidic device and an electrode external to and not bonded to the device. In the method, the external electrode is placed adjacent to the device and energized to generate an electric (Continued)

field that extends through the wall of the device and into the channel, thereby manipulating an object within the channel.

14 Claims, 2 Drawing Sheets

(52) U.S. Cl.
CPC ..... *B03C 5/005* (2013.01); *B03C 5/026* (2013.01); *B01L 2200/0647* (2013.01); *B01L 2300/0645* (2013.01); *B01L 2300/0816* (2013.01); *B01L 2300/0819* (2013.01); *B01L 2400/0424* (2013.01); *B01L 2400/0427* (2013.01); *B01L 2400/0487* (2013.01); *B03C 2201/26* (2013.01)

(56) References Cited

U.S. PATENT DOCUMENTS

| | | | | |
|---|---|---|---|---|
| 8,162,149 | B1 | 4/2012 | Perroud et al. | |
| 2002/0124896 | A1 | 9/2002 | O'Connor et al. | |
| 2002/0182627 | A1 | 12/2002 | Wang et al. | |
| 2004/0011650 | A1* | 1/2004 | Zenhausern ..... | B01L 3/502746 204/547 |
| 2005/0019213 | A1 | 1/2005 | Kechagia et al. | |
| 2005/0273995 | A1* | 12/2005 | Kanagasabapathi .... | B03C 5/026 29/592.1 |
| 2005/0284762 | A1* | 12/2005 | Astorga-Wells ..... | B01L 3/502753 204/451 |
| 2007/0034270 | A1 | 2/2007 | Yang et al. | |
| 2007/0163884 | A1* | 7/2007 | Strand ..... | B01D 61/425 204/548 |
| 2007/0240989 | A1* | 10/2007 | Levitan ..... | B01F 13/0076 204/451 |
| 2009/0098541 | A1 | 4/2009 | Southern et al. | |
| 2009/0298059 | A1 | 12/2009 | Gumbrecht et al. | |
| 2010/0003666 | A1 | 1/2010 | Lee et al. | |
| 2010/0006441 | A1* | 1/2010 | Renaud ..... | B01L 3/502746 204/643 |
| 2010/0025250 | A1 | 2/2010 | Pamula et al. | |
| 2010/0224493 | A1 | 9/2010 | Davalos et al. | |
| 2010/0240092 | A1 | 9/2010 | Igata | |
| 2010/0317093 | A1 | 12/2010 | Turewicz et al. | |
| 2011/0030808 | A1 | 2/2011 | Chiou et al. | |
| 2011/0290647 | A1 | 12/2011 | Feiglin | |
| 2012/0236299 | A1 | 9/2012 | Chiou et al. | |
| 2012/0264654 | A1 | 10/2012 | Dendukuri et al. | |
| 2013/0337500 | A1 | 12/2013 | Tan et al. | |
| 2016/0194702 | A1* | 7/2016 | Schroeder ..... | B01L 3/502715 435/6.12 |

FOREIGN PATENT DOCUMENTS

| | | | |
|---|---|---|---|
| EP | 2153898 | A1 | 2/2010 |
| TW | 200706484 | A | 2/2007 |
| WO | 2008106678 | A1 | 9/2008 |
| WO | 2009010719 | A1 | 1/2009 |
| WO | 2011/002957 | A2 | 1/2011 |
| WO | 2013075902 | A1 | 5/2013 |

OTHER PUBLICATIONS

International Search Report & Written Opinion issued in corresponding international application No. PCT/US2013/073437, dated Mar. 19, 2014.

Zhong et al., A microfluidic processor for gene expression profiling of single human embryonic stem cells, Lab Chip, 8 (1): 68-74, Jan. 2008.

First Search Report issued in corresponding Chinese application No. 2013-80063560.5, dated Mar. 28, 2016.

First Office Action issued in corresponding Chinese application No. 2013-80063560.5, dated Apr. 6, 2016.

Examination Report issued in corresponding European application No. 13 815 260.8, dated Oct. 17, 2018.

First Examination Report issued in corresponding India patent application No. 3701/CHENP/2015, dated Aug. 22, 2019.

* cited by examiner

MANIPULATION OF OBJECTS IN MICROFLUIDIC DEVICES USING EXTERNAL ELECTRODES

CROSS-REFERENCE TO RELATED APPLICATION

This application is a divisional of, and claims the benefit of, U.S. patent application Ser. No. 13/705,670 filed Dec. 5, 2012, the disclosure of which is herein incorporated by reference.

TECHNICAL FIELD

The present disclosure is in the field of microfluidic devices and systems. In particular, described herein are microfluidic devices and systems designed to manipulate an object using an external electrode and methods for manipulating an object within a channel of a microfluidic device using an external electrode.

BACKGROUND OF THE INVENTION

Droplet microfluidics is an area of increasing interest for high-throughput bioanalysis. An aqueous droplet suspended in a bio-inert medium such as fluorocarbon oil can be considered a "nanoreactor," isolated from the environment, in which an experiment can be performed on a minimal amount of biological material. The droplet architecture is ideally suited to performing measurements on single cells and eliminates the possibility of cross-contamination with other cells. The small volume of a droplet is also advantageous as it avoids excessive dilution of the bio-content of a cell. Most important, the high throughput of hundreds or even thousands of droplets per second enables meaningful statistics in single-cell studies and studies of other material contained within a droplet.

A key component in such processing is the ability to actuate the droplets with precision in both space and time. This can be accomplished by combining hydrodynamic flow for high speed transport with dielectrophoresis (DEP) for slower but precisely controlled transport along arbitrary paths. In dielectrophoresis, a force is exerted on a dielectric particle when it is subjected to a non-uniform electric field. All particles exhibit some dielectrophoretic activity in the presence of an electric field regardless of whether the particle is or is not charged. The particle need only be polarizable. The electric field polarizes the particle, and the resulting poles experience an attractive or repulsive force along the field lines, the direction depending on the orientation of the dipole. The direction of the force is dependent on field gradient rather than field direction, and so DEP occurs in alternating current (AC) as well as direct current (DC) electric fields. Because the field is non-uniform, the pole experiencing the greatest electric field will dominate over the other, and the particle will move.

Thus, dielectrophoresis can be used to transport, separate, sort, and otherwise manipulate various objects. In the prior art, such manipulations have typically been accomplished using microfluidic devices that have electrodes deposited within the channels of the device. For example, U.S. Pat. No. 6,203,683 to Austin et al. teaches a microfluidic device for trapping nucleic acids on an electrode by dielectrophoresis, thermocycling them on the electrode, and then releasing them for further processing. The device includes a microfluidic channel that has field electrodes positioned to provide a dielectrophoretic field in the channel and a single trapping electrode positioned in the channel between the field electrodes.

According to Austin et al., the device is fabricated by forming the channel and included electrodes on a surface of a substrate and then covering that surface with a coverslip. The resulting electrodes are fixed within the channel and are an integral part of the device. As a result of using this typical method of electrode formation, dielectrophoretic manipulations can take place only in the specific locations defined by the fixed electrodes, and the electrodes are discarded along with the used device. As platinum is the particularly preferred electrode material specified by Austin et al., the electrodes can add significant cost to a disposable device.

In performing dielectrophoretic manipulations, it would be desirable in many applications to have the ability to apply electric fields at arbitrary locations within a microfluidic device rather than only at predefined locations where electrodes are deposited during fabrication of the device. Further, it would be advantageous to eliminate the cost of included electrodes to be used in dielectrophoresis in a microfluidic device, thereby providing a less expensive disposable device.

SUMMARY OF THE INVENTION

One aspect of the present invention is a microfluidic device comprising a channel disposed within the device, the channel having no included electrodes. The channel has a wall, at least a portion of which is penetrable by an electric field generated external to the device, the wall being penetrable such that the electric field extends through the wall portion and into a region within the channel.

Another aspect of the present invention is a system for manipulating an object within a channel of a microfluidic device. The system comprises a microfluidic device and an electrode external to the microfluidic device. The microfluidic device comprises a channel disposed within the device, the channel having no included electrodes. The channel has a wall, at least a portion of which is penetrable by an electric field generated external to the device, the wall being penetrable such that the electric field extends through the wall portion and into a region within the channel. The external electrode is adjacent to and not bonded to the device. The electrode generates the external electric field.

Yet another aspect of the present invention is a method for manipulating an object within a channel of a microfluidic device. The method comprises providing a microfluidic device comprising a channel disposed within the device, the channel having no included electrodes. The channel has a wall, at least a portion of which is penetrable by an electric field generated external to the device. An electrode external to the microfluidic device is also provided. The electrode is placed adjacent to the penetrable wall portion of the microfluidic device and energized to generate an electric field. The penetrable wall portion is penetrated with the electric field such that the electric field extends through the wall portion and into a region within the channel. An object is introduced into the channel and manipulated within the channel using the electric field.

The aforementioned and other features and advantages of the invention will become further apparent from the following detailed description of the presently preferred embodiments, read in conjunction with the accompanying drawings, which are not to scale. In the drawings, like reference numbers indicate identical or functionally similar elements. The detailed description and drawings are merely illustrative of the invention, rather than limiting, the scope of the invention being defined by the appended claims and equivalents thereof.

BRIEF DESCRIPTIONS OF THE DRAWINGS

Figure 3:
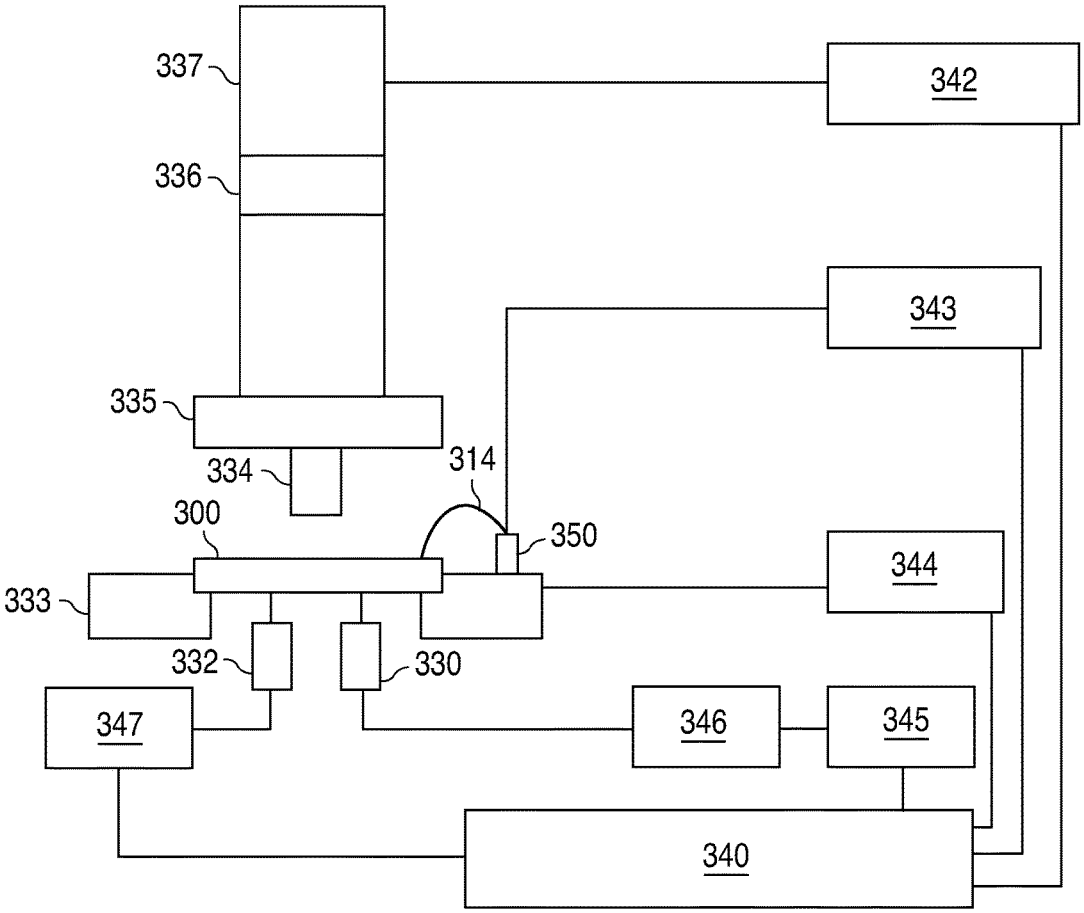
Figure 4A:
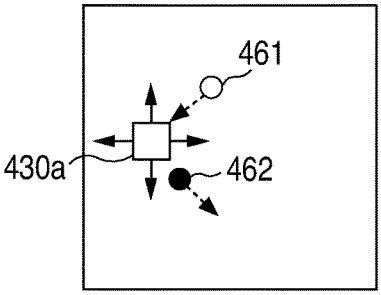
Figure 4B:
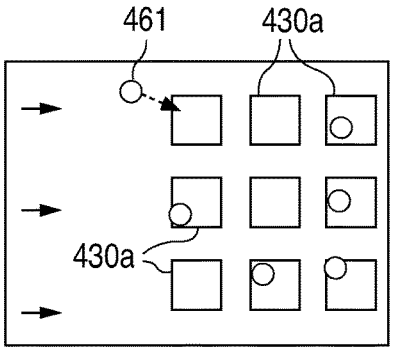
Figure 4C:
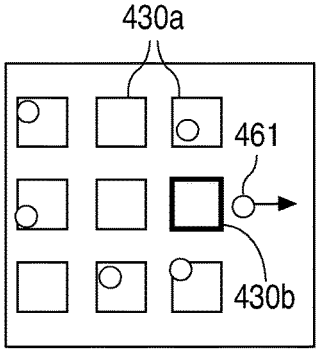

FIG. 3 is a block diagram of a system for manipulating an object within a channel of a microfluidic device using an external electrode, in accordance with the present invention; and FIGS. 4A-4C illustrate examples of dielectrophoretic manipulations of objects using one or more external electrodes, FIG. 4A illustrating separation of objects based on differing electrical or dielectrical properties by a translatable external electrode, FIG. 4B illustrating immobilization of objects by an array of external electrodes, all electrodes of the array shown as active, and FIG. 4C illustrating the electrode array of FIG. B with a single electrode deactivated to selectively release one of the objects seen immobilized in FIG. 4B.

DETAILED DESCRIPTION OF THE PRESENTLY PREFERRED EMBODIMENTS

Figure 1:
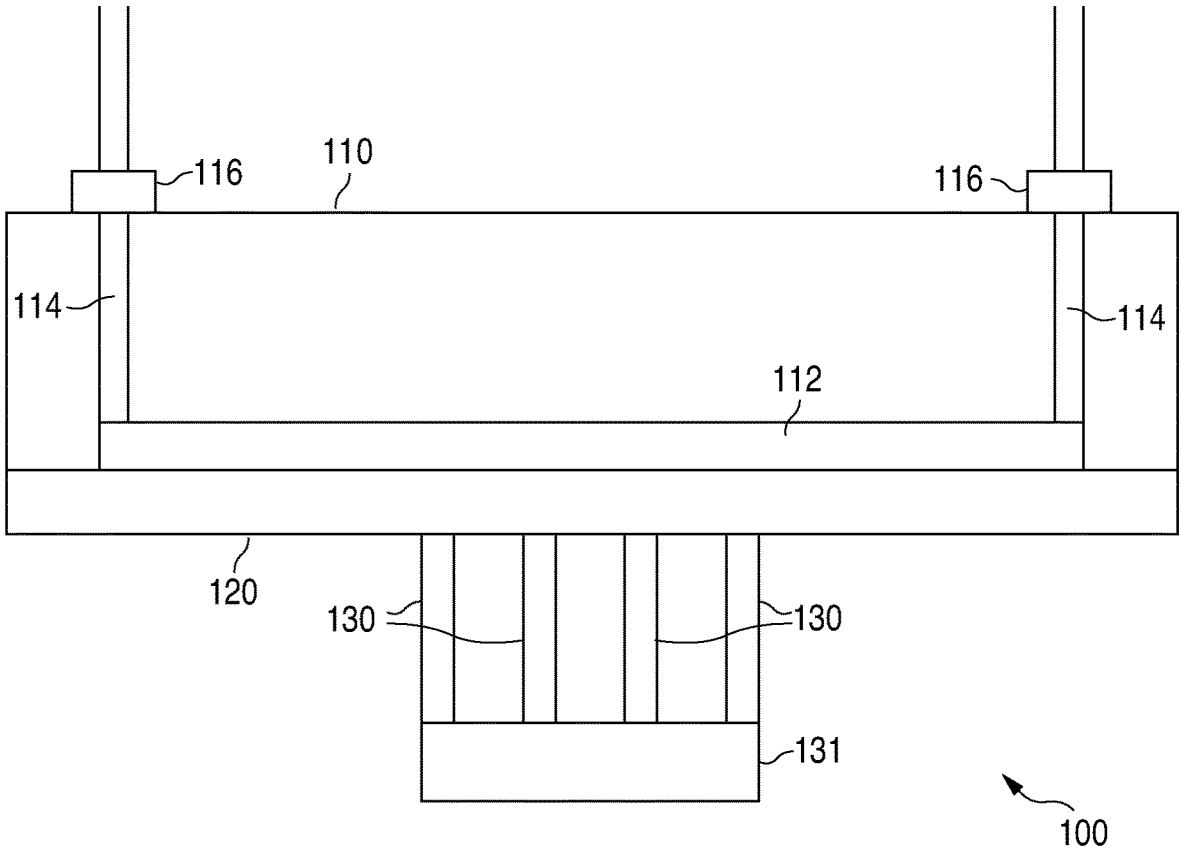
FIG. 1 is a schematic illustration of one embodiment of a microfluidic device, in accordance with the present invention, and an array of electrodes external to the device.

One aspect of the present invention is a microfluidic device. The device comprises a channel having no electrodes included within the channel. One wall of the channel is uniquely designed to permit the penetration of an external electric field such that the electric field extends through the wall portion and into a region within the channel. As described in more detail below with respect to a system that includes the microfluidic device, the electric field is generated by an electrode or electrode array that is external to the wall portion and not bonded to the device. In operation for manipulating objects using dielectrophoresis, the electrode or electrode array is placed either in physical contact with or in proximity to the outside surface of the wall portion FIG. 1 illustrates one embodiment of the microfluidic device. As illustrated, device 100 includes a channel layer 110 and a cover layer 120. Channel 112 is formed in channel layer 110. Cover layer 120 forms one wall of the channel and provides a covered channel disposed within the device. Apertures 114 extend through the substrate layer and are in fluid communication with channel 112. In the present embodiment, fluidic connectors 116 are attached to, or at least partially disposed within, the apertures for introducing liquids or gases into the channel. Although microfluidic device 100 is shown in FIG. 1 as a substantially planar, rectangular device, other configurations are possible.

Channel layer 110 as seen in FIG. 1 is a single layer; however, the channel layer can comprise multiple layers assembled to form the channel layer. Suitable materials for the channel layer include elastomers and polymers such as polydimethylsiloxane (PDMS), polymethylmethacrylate (PMMA), polycarbonate, polytetrafluoroethylene (PTFE), polyvinylchloride (PVC), polysulfone, polystyrene, polymethylpentene, polypropylene, polyethylene, polyvinylidine fluoride, ABS (acrylonitrile-butadiene-styrene copolymer), cyclic-olefin polymer (COP), and cyclic-olefin copolymer (COC). Other suitable materials include glass, quartz, and silicon. The thickness of the channel layer is dependent on the depth of the channel to be formed in the layer and other factors such as the instrument with which the device will be used.

Channel 112 can be formed in channel layer 110 by a variety of methods known in the art, including photolithography, machining, molding, wet chemical etching, reactive ion etching (RIE), laser ablation, air abrasion techniques, injection molding, LIGA methods, metal electroforming, embossing, and combinations thereof. Surface properties of the channel are important, and techniques are known in the art to either chemically treat or coat the channel surfaces so that those surfaces have the desired properties. For example, glass can be treated (e.g., covered with PDMS or exposed to a perfluorinated silane) to produce channel walls that are hydrophobic and therefore compatible with a fluorocarbon oil. In the case of semiconductive materials such as silicon, an insulating coating or layer (e.g., silicon oxide) can be provided over the channel layer material. The channel includes no electrodes disposed within the channel.

Cover layer 120 is affixed to channel layer 110 such that channel 112 is thereby covered and thus disposed within device 100. As can be seen in FIG. 1, cover layer 120 forms one wall of channel 112. At least a portion of the channel wall formed by the cover layer consists of a material that is penetrable by an electric field generated external to the device, the electric field thereby extending through the wall portion and into a region within the channel. The field falls off away from the external electrode, thus creating a specific region within the channel in which the field gradient is sufficient to exert a non-negligible force on a target object. Only the portion of the wall through which the electric field will be transmitted (see, e.g., wall portion 222 of cover layer 220 in FIG. 2) is required to be made from a material penetrable by an external field; however, typically the entire cover layer will consist of such a material.

Either the entire cover layer 120 or only the penetrable wall portion of the cover layer can be made of a dielectric material such as glass or a plastic material. Alternatively, the entire cover layer 120 or penetrable wall portion can be made of an anisotropically conducting material, defined herein as a material that possesses the property of anisotropic electrical conductivity, with the direction of high conductivity oriented orthogonally to the plane in which the channel is formed. The thickness of the cover layer will depend on the material used, with a dielectric material preferably being ≤100 microns thick and an anisotropically conducting material preferably being ≤5 mm thick. The cover layer can be a substantially rigid material similar to, for example, a glass cover slip or can, alternatively, be in the form of a flexible film or sheet. Dielectric films are commercially available; for example, a plastic film would be an acceptable dielectric film. Anisotropically conducting films are also commercially available, with various anisotropic conductive films being offered by the 3M company, for example.

Cover layer 120 can be affixed to channel layer 110 by any appropriate method known in the art, those methods including chemical bonding, thermal bonding, adhesive bonding, and pressure sealing. In one example, bonding of a glass cover layer to a PDMS channel layer can be achieved by applying an oxygen plasma treatment to the glass and PDMS surfaces. The oxygen plasma forms chemically reactive OH groups that convert to covalent Si—O—Si bonds when the surfaces are brought into contact. In another example, a thin polymer (dielectric) or anisotropically conducting film or sheet can be bonded to a channel layer using thermal or adhesive bonding or pressure sealing.

As seen in FIG. 1, channel 112 is covered but not closed, apertures 114 being formed through channel layer 110 such that they are in fluid communication with channel 112. Apertures 114 function as openings through which materials (e.g., liquids or gases) can be introduced into or withdrawn from channel 112 and also as ports for coupling controllers for directing movement of materials within the channel. In the present embodiment, two apertures 114 intersect channel 112, one adjacent to each end of the channel. The apertures are thereby in fluid communication with the channel. Those skilled in the art will appreciate that the number of apertures 114 may be varied. Additionally, the apertures may be formed through cover layer 120 instead of channel layer 110; however, the relative thicknesses of the channel layer and the cover layer make it preferable that the apertures be disposed in the channel layer. The apertures are formed by, for example, etching, drilling, punching, or any other appropriate method known in the art.

In the embodiment illustrated in FIG. 1, two fluidic connectors 116 are connected to apertures 114. Fluidic connectors 116 can be, for example, tubing that is inserted into or otherwise mated with apertures 114. The fluidic connectors can be elements of device 100 or may, alternatively, be elements of an instrument configured to interact with the device, such as is described below. The number of connectors is variable.

Figure 2:
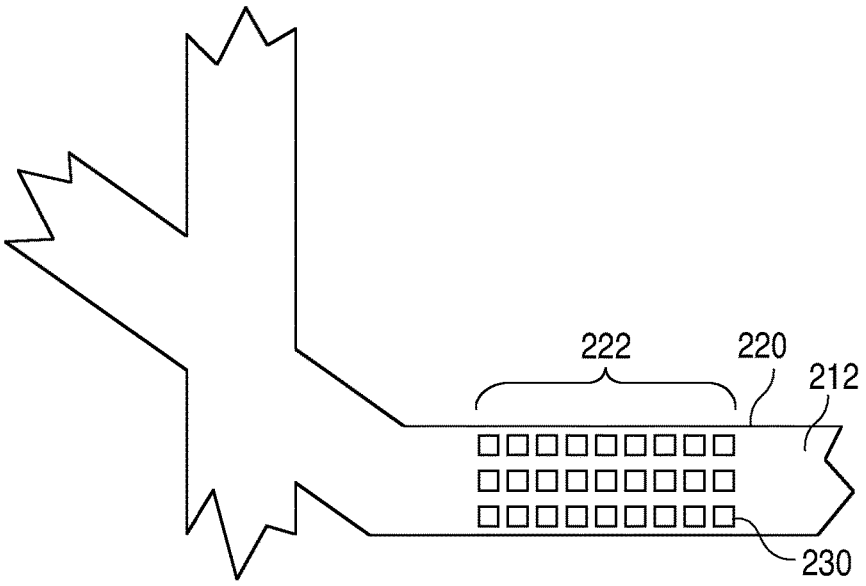
FIG. 2 is a schematic illustration of another embodiment of a microfluidic device, in accordance with the present invention, and an array of electrodes external to the device.

In an alternative embodiment of the device, the channel having the penetrable wall portion may be part of a network of channels as seen in device 200 illustrated in FIG. 2. In this embodiment, apertures may be in fluid communication with the channel having the penetrable wall portion, seen at 212 in FIG. 2, via other channels within the network rather than directly as seen in FIG. 1. In this embodiment, a controller coupled to an aperture could direct movement of materials not only within channel 212, but also among the other channels within the device. In this embodiment, channel 212 may be either an individual channel or a segment of a larger channel, the segment positioned at either end of the larger channel or with a portion of the larger channel extending from either end of the segment. An array of external electrodes 230 is seen as if viewed through channel 212.

Another aspect of the present invention is a system for manipulating an object within a channel of a microfluidic device, the system comprising a microfluidic device and an electrode external to the device, the electrode being adjacent to and not bonded to the device. The microfluidic device is as described above and illustrated in FIGS. 1 and 2. I.e., the device has a channel that includes no electrodes. The channel has a wall, at least a portion of which is penetrable by an electric field generated external to the device, the wall portion penetrable such that the electric field extends through the wall portion and into a region within the channel. Objects to be manipulated within the channel include, for example, cells, droplets, particles, molecules, and combinations thereof. The act of manipulating the object(s) includes immobilizing the object(s), releasing the object(s), moving the object(s), merging the object with another object (e.g., merging a cell with a droplet or a droplet with another droplet), and combinations thereof.

In one embodiment, seen in FIG. 1, electrode 130 is one of an array of electrodes. The array may be, for example, multiple metal pads on a printed circuit board (PCB) or multiple needle electrodes (i.e., substantially needle-shaped conductors of electric current) held together by a fixture 131. One skilled in the art will appreciate that other electrode arrays are possible.

In another embodiment, seen in FIG. 3, electrode 330 is a single electrode such as, for example, a single needle electrode, a single metal pad on a PCB, or another electrode such as is known in the art.

When the system is in operation, the electrode or electrode array is adjacent to an external surface of the penetrable wall portion of the microfluidic device. I.e., the electrode or electrode array is either in physical contact with or in proximity to the external surface of the penetrable wall portion. "In proximity to" is defined herein as being within 100 microns of the external surface of the penetrable wall portion. The electrode or electrode array is preferably within 10 microns of or in contact with the external surface of the penetrable wall portion. The electrode or electrode array is not bonded to the microfluidic device. Once positioned adjacent to the microfluidic device, the electrode or electrode array may remain fixed in position with respect to the wall portion or may be translatable across the external surface of the wall portion (i.e., the electrode or electrode array is movable in the plane of the wall such that the electrode or electrode array moves across the external surface of the penetrable wall portion). The electrode or electrode array generates an electric field using either alternating current (AC) or direct current (DC).

The electrode or electrode array employed in manipulating the object(s) is separate from the microfluidic device, thus reducing the cost of fabricating the device by eliminating electrode deposition steps during manufacture of the device. Having no electrodes within a channel of the device also avoids discarding the electrodes employed in manipulating the object(s) with each device, the electrodes potentially made from costly materials such as platinum. Further, because the external electrode(s) can be moved into any position relative to the microfluidic device and may be translatable across the external surface of the device, there is no need to customize the device itself for any single use, the external electrode(s) offering virtually unlimited options for manipulating the object(s) within the device.

The electrode or electrode array can be a constituent of an instrument that is configured to interact with the microfluidic device. One such instrument is illustrated in FIG. 3, in which the instrument comprises a needle electrode 330, a laser 332, a stage 333 upon which a microfluidic device 300 is accommodated, an objective 334, an excitation filter wheel 335, a tunable emission filter 336, and a charge-coupled device (CCD) camera 337. These constituents are linked to a computer 340 by or in association with a camera module controller 342, a multiport pressure controller 343, a stage controller 344, a function generator 345, a high voltage amplifier 346, and a diode laser controller 347. A vial 350 containing objects to be manipulated is shown connected to microfluidic device 300 via a fluidic connector 314. One of ordinary skill in the art will appreciate that the instrument illustrated in FIG. 3 is just one of many possible instruments comprising an electrode or electrode array.

Example 1

In one system in accordance with the present invention, a needle electrode is either fixed or translatable relative to an external surface of a microfluidic device having a penetrable wall portion consisting of a thin (e.g., ≤100 microns in thickness) polymer (dielectric) film. With the electrode in contact with the penetrable wall portion, this configuration would require a relatively high AC voltage (≥100 volts) in order to dielectrophoretically attract and move objects such as aqueous droplets flowing in an oil stream within the channel. Cells flowing in an aqueous solution might also be manipulated by this configuration, but the polymer film would need to be thinner than for use with an aqueous droplet (e.g., ≤10 microns in thickness). Where the system comprises multiple needle electrodes in an array, the array may be controlled by energizing various individual electrodes in a controlled sequence.

Example 2

In another system in accordance with the present invention, a needle electrode is either fixed or movable relative to an external surface of a microfluidic device having a penetrable wall portion consisting of an anisotropically conductive layer (conductive through the thickness and insulating in the plane of the layer). With the electrode either in contact with or in proximity to the penetrable wall portion, this configuration would require a relatively low AC voltage (≤10 volts) in order to dielectrophoretically attract and move either aqueous droplets flowing in an oil stream or cells flowing in an aqueous solution within the channel. Where the system comprises multiple needle electrodes in an array, the array may be controlled by energizing various individual electrodes in a controlled sequence.

Example 3

In yet another system in accordance with the present invention, a metal pad on a PCB or an array of metal pads on a PCB is either fixed or movable relative to a microfluidic device having a penetrable wall portion consisting of an anisotropically conductive layer (conductive through the thickness and insulating in the plane of the layer). With the electrode(s) in contact with the penetrable wall portion, this configuration would require a relatively low AC voltage (≤10 volts) in order to dielectrophoretically attract and move either aqueous droplets flowing in an oil stream or cells flowing in an aqueous solution within the channel. The electrode array may be controlled by energizing various pads in a controlled sequence.

Yet another aspect of the present invention is a method of manipulating an object within a channel of a microfluidic device. In the method, a microfluidic device is provided. The device comprises a channel disposed within the device, the channel having no included electrodes. The channel has a wall, at least a portion of which is penetrable by an electric field generated external to the device. An electrode is also provided, the electrode external to the microfluidic device and not bonded to the device.

The electrode is placed adjacent to the penetrable wall portion of the microfluidic device. Placing the electrode adjacent to the device includes both placing the electrode in physical contact with the penetrable wall portion and placing the electrode in proximity to (i.e., within 100 microns of and preferably within 10 microns of) the penetrable wall portion.

The electrode is energized to generate an electric field. Energizing is accomplished using either an alternating current or a direct current. The penetrable wall portion is penetrated by the electric field such that the electric field extends through the wall portion and into a region within the channel.

An object is introduced into the channel either before or after the electrode is energized, typically by pressure-driven flow, and manipulated within the channel using the electric field. The object can be manipulated either dielectrophoretically or electrophoretically. Examples of dielectrophoretic manipulations of objects using one or more electrodes can be seen in FIGS. 4A-4C.

Objects to be manipulated within the channel include, for example, cells, droplets, particles, molecules, and combinations thereof. The act of manipulating the objects includes immobilizing, releasing, or moving the objects and combinations thereof.

FIG. 4A illustrates separation of objects based on differing electrical or dielectrical properties by a translatable external electrode. As illustrated, the activated electrode 430*a*, which may be a needle electrode or another type of electrode, is translatable in four directions, allowing an object that is attracted to the electrode to be moved to any location within the channel, thus separating the desired object 461 from other objects 462 within the channel. For example, an individual cell might be manipulated using a translatable external electrode to move the cell to a desired position. Alternatively, a droplet might be moved to the position of a cell that is immobilized on the surface of the channel, allowing the contents of the cell to be collected in the droplet via lysis or detachment of the cell.

FIG. 4B illustrates immobilization of objects 461 by an array of activated external electrodes 430*a*. Once the objects have been immobilized by the electrode array, a single object may be selectively released by deactivation of a single electrode 430*b* as illustrated in FIG. 4C. (One skilled in the art will appreciate that multiple electrodes may be deactivated to release multiple objects.) Selective release of the individual target object(s) allows the object(s) to be flowed out of the device through an aperture in the device or into other areas of a multi-channel device for further interrogation by analytical techniques such as polymerase chain reaction (PCR), fluorescence in situ hybridization (FISH), and immunochemistry. Arrows in FIG. 4B indicate direction of flow.

While the embodiments of the invention disclosed herein are presently considered to be preferred, various changes and modifications can be made without departing from the spirit and scope of the invention. The scope of the invention is indicated in the appended claims, and all changes and modifications that come within the meaning and range of equivalents are intended to be embraced therein.

What is claimed is:

1. A system for manipulating an object within a channel of a microfluidic device, the system comprising:

the microfluidic device comprising a channel disposed therein, the channel comprising a wall, wherein the entirety of the wall is penetrable by an electric field generated external to the microfluidic device, the wall being penetrable such that the electric field extends through a wall portion and into a region within the channel; and an electrode external to the microfluidic device, the electrode being adjacent to and not bonded to the microfluidic device, wherein the electrode is configured to generate the electric field external to the microfluidic device; and wherein the electrode is translatable across an external surface of the microfluidic device.

2. The system of claim 1 wherein the electrode is in physical contact with the external surface of the wall portion of the penetrable wall of the microfluidic device.

3. The system of claim 1 wherein the electrode is in proximity to the external surface of the penetrable wall portion of the device.

4. The system of claim 1 wherein the electrode is translatable across the external surface of the penetrable wall portion of the device.

5. The system of claim 1 wherein the electrode is a needle electrode.

6. The system of claim 1 wherein the electrode is one of an array of electrodes.

7. The system of claim 1 wherein the electrode generates the electric field using an alternating current.

8. The system of claim 1 wherein the electrode generates the electric field using a direct current.

9. The system of claim 6 wherein the array is arranged in a two dimensional grid.

10. The system of claim 6 wherein the array is held together by a fixture.

11. A system for manipulating an object, the system comprising:

a microfluidic device comprising:

a channel layer;

a cover layer immediately adjacent to the channel layer, the cover layer and the channel layer defining a channel between the cover layer and the channel layer, the entirety of the cover layer being penetrable by an electric field extending into the channel; and at least one electrode adjacent to and not bonded to the cover layer, at a side of the cover layer opposite the channel, the electrode being translatable across the external surface of the device, and the electrode being operable to generate the electric field external to the cover layer and channel layer;

wherein no electrodes are provided within or adjacent to the channel layer.

12. The system of claim 11 wherein the at least one electrode is one of an array of electrodes, the array being arranged in a two dimensional grid.

13. The system of claim 12 wherein the array is held together by a fixture.

14. A system for manipulating an object within a channel of a microfluidic device, the system comprising:

the microfluidic device comprising a channel disposed therein, the channel comprising a wall, wherein the entirety of the wall is penetrable by an electric field generated external to the microfluidic device, the wall being penetrable such that the electric field extends through a wall portion and into a region within the channel; and an array of electrodes arranged in a two-dimensional grid external to the microfluidic device, the array of electrodes being adjacent to and not bonded to the microfluidic device, wherein the array of electrodes generates the electric field external to the microfluidic device, and wherein at least one electrode in the array of electrodes is translatable across an external surface of the device.

* * * * *